United States Patent [19]

Radzilowski

[11] 4,214,899

[45] Jul. 29, 1980

[54] METHOD FOR THE ADDITION OF A REACTIVE METAL TO A MOLTEN METAL BATH

[75] Inventor: Ronald H. Radzilowski, Youngstown, N.Y.

[73] Assignee: Union Carbide Corporation, New York, N.Y.

[21] Appl. No.: 19,158

[22] Filed: Mar. 9, 1979

[51] Int. Cl.[2] ..... C21C 7/02

[52] U.S. Cl. ..... 75/58; 75/59; 75/96; 75/129; 75/130 R

[58] Field of Search ..... 75/58, 67, 59, 130 R, 75/96, 129

[56] References Cited

U.S. PATENT DOCUMENTS 3,545,960 12/1970 McClellan ..... 75/129
4,089,678 5/1978 Hanawalt ..... 75/67 A

FOREIGN PATENT DOCUMENTS 404518 1/1934 United Kingdom ..... 75/96

*Primary Examiner*—P. D. Rosenberg
*Attorney, Agent, or Firm*—J. Hart Evans

[57] ABSTRACT

A method for the addition of a reactive metal to a molten metal bath wherein the vapor pressure of the reactive metal at the bath temperature exceeds the total ambient pressure above the surface of the bath by establishing a gaseous atmosphere containing a nonreactive gas and a small quantity of $SF_6$ above the surface of the bath so as to increase the recovery of the reactive metal addition in the bath.

14 Claims, 1 Drawing Figure

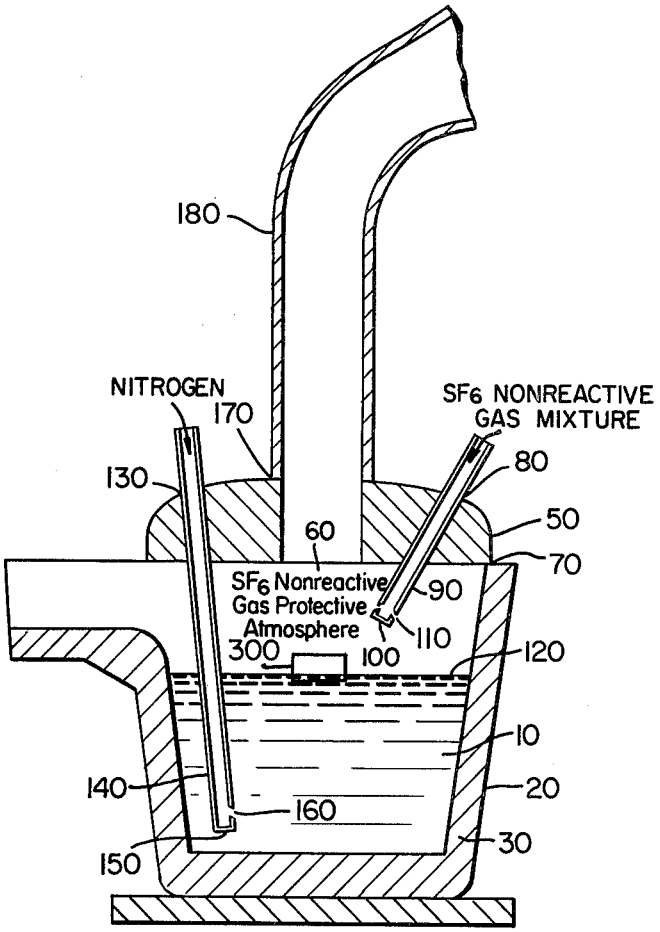
180
NITROGEN
170
SF6 NONREACTIVE
GAS MIXTURE
80
130
50
60
70
SF6 Nonreactive
Gas Protective
Atmosphere
90
110
300
100
120
10
140
20
160
30
150

METHOD FOR THE ADDITION OF A REACTIVE METAL TO A MOLTEN METAL BATH

The present invention relates to a method for the addition of reactive metals to a molten metal bath wherein improved recoveries of the reactive metal addition are obtained. More particularly, the present invention relates to a method for the addition of magnesium to molten ferrosilicon alloys wherein improved recoveries of magnesium are obtained.

BACKGROUND OF THE INVENTION

In the metallurgical industries it is a common practice in the production of alloys to add a metal to be alloyed directly to a molten bath of the metal with which it is to be alloyed wherein the metal to be alloyed dissolves in the molten bath thereby forming the desired alloy in molten form. In many instances, the metal to be added to the bath has a vapor pressure at the temperature of the molten bath to which it is added which exceeds the total ambient pressure and is readily oxidizable. In these instances, the addition of the metal to be alloyed to the molten metal bath results in vaporization and oxidation of the metal added resulting in losses of the metal addition and hence reduced recoveries of the metal addition in the bath as well as a safety hazard caused by the accompanying flare and fumes. The economic impact of such metal losses in commercial scale operations is significant and the reduction of such vaporization losses by even one percent based on the weight of the metal or alloy thereof added to the molten bath can result in considerable cost savings in a plant scale operation.

A reactive metal will therefore be defined as a metal added in elemental or alloy form to a molten metal or metal alloy bath the temperature of which is such that the vapor pressure of the metal addition at the bath temperature exceeds the total ambient pressure with such addition resulting in the vaporization of the added metal. The term reactive metal includes reactive metal base alloys. Reactive metal additions referred to herein are those reactive metals which float on the bath and are gradually dissolved therein.

Examples of the addition of reactive metals to a molten metal bath which are common in industrial practice include: Magnesium (boiling point=1107° C.) which is added to a molten ferrosilicon bath to form alloys containing about 1 to 9 percent magnesium by weight for the purpose of producing nodularizing alloys for cast iron. In this instance, the temperature of the molten ferrosilicon bath typically ranges from about 1320° C. to 1600° C. at which temperatures the vapor pressure of magnesium ranges from 3514 to 14800 mm Hg while the total ambient pressure would be approximately 760 mm Hg (i.e. approximately standard atmospheric pressure). Such additions result in vaporization of the added magnesium and hence an accompanying loss of magnesium metal.

Calcium (boiling point=1440° C.) is added to molten iron or steel baths at temperature of approximately 1600° C. for the purpose of desulfurization and deoxidation. At a temperature of 1600° C., the vapor pressure of calcium is 2980 mm Hg thus exceeding the approximate total ambient pressure of 760 mm Hg which results in the vaporization of the calcium addition.

Magnesium is added to molten aluminum silicon baths at temperatures of approximately 1400° C. for the purpose of making magnesium aluminum silicon casting alloys. At a temperature of 1400° C., the vapor pressure of magnesium is 5570 mm Hg thus exceeding the approximate total ambient pressure of 760 mm Hg which results in vaporization of the magnesium addition.

Strontium or calcium is added to molten ferrosilicon at bath temperatures which would frequently exceed the boiling point of strontium (1380° C.) or calcium (1440° C.) for the purpose of making nodularizing or inoculant alloys for cast iron. In these instances, the vapor pressure of the strontium or calcium would exceed the total ambient pressure resulting in vaporization of the strontium or calcium addition.

Magnesium is added to molten iron in small quantities for the purpose of nodularizing the graphite in the iron. In this instance, the temperature of the molten iron bath typically ranges from about 1350° C. to 1500° C. thus exceeding the boiling point of magnesium (1107° C.) and therefore the vapor pressure of the magnesium exceeds the total ambient pressure resulting in the vaporization of the magnesium addition.

It is known in the prior art that gaseous sulfur hexafluoride ($SF_6$), an odorless, colorless, nontoxic gas, is effective in dilute quantities for providing a protective atmosphere for magnesium melting and casting operations. Such melting and casting operations are typically carried out at temperatures of about 500° to 700° C. with the temperature being largely dependent on the melting temperature of the magnesium or the magnesium alloy which is the subject of the operation. However, these temperatures are significantly below the boiling point of magnesium (1107° C). Such uses of sulfur hexafluoride are described, for example, in U.S. Pat. No. 4,089,678—Hanawalt, U.S. Pat. No. 3,400,752—Unsworth and Proceedings of the International Magnesium Association, May 22–24, 1977, "Melting Magnesium Under Air/$SF_6$ Protective Atmosphere," pages 16–20, S.L. Couling et.al. However, the known prior art references do not discuss the use of dilute $SF_6$ atmospheres in conjunction with the handling of reactive metals at temperatures at which the vapor pressure of the reactive metal exceeds the total ambient pressure.

Prior art methods concerning the addition of reactive metals to molten metal baths include U.S. Pat. No. 3,545,960—McClellan, the disclosure of which is incorporated herein by reference, which discloses the agitation of a molten metal bath to which a solid material is added by injecting a nonreactive gas, for example nitrogen, below the surface of the bath to effect the homogeneous intermixing of the metal bath and the solid addition. Practice of such a method would establish a nonreactive gas atmosphere over the bath.

OBJECT OF THE INVENTION

It is therefore an object of the present invention to provide an efficient, economical method for the addition of reactive metals to a molten metal bath at a temperature at which the vapor pressure of the reactive metal addition exceeds the total ambient pressure so as to improve the recoveries of the reactive metal addition in the bath.

It is a further object of the present invention to provide an efficient and economical method for the addition of magnesium to a molten ferrosilicon bath so as to improve the recoveries of the magnesium in the ferrosilicon bath.

Other objects of this invention will be apparent from the following description and claims taken in conjunction with the drawing wherein:

The single FIGURE shows a molten metal bath for the practice of a particular embodiment of the present invention.

In the method of the present invention, it has been discovered that establishing a gaseous atmosphere of small quantities of gaseous $SF_6$ in a nonreactive diluent gas over a molten metal bath will surprisingly and unexpectedly be effective to increase the recovery of a reactive metal added to the molten metal bath being maintained at a temperature at which the vapor pressure of the reactive metal addition exceeds the total ambient pressure upon the dissolution of the reactive metal in the molten bath over that recovery obtained without the gaseous atmosphere. A nonreactive diluent gas is a gas which does not substantially react with small quantities of $SF_6$ or substantially react with the molten bath so as to substantially degrade the herein described effectiveness of the dilute $SF_6$ gaseous atmosphere.

SUMMARY OF THE INVENTION

The present invention comprises a method for the addition of a reactive metal to a molten metal bath which comprises:

(a) providing a bath of molten metal;

(b) establishing a gaseous atmosphere above the surface of the bath consisting essentially of a nonreactive gas containing from about 100 to 3000 parts per million $SF_6$;

(c) establishing the bath of molten metal at a temperature at which a selected reactive metal exhibits a vapor pressure exceeding the total ambient pressure of the gaseous atmosphere above the surface of the bath;

(d) depositing the selected reactive metal on the surface of the bath for dissolution therein;

wherein the recovery of the reactive metal addition in the molten metal path upon the dissolution of the reactive metal in the molten metal bath is increased over that recovery obtained without the gaseous atmosphere.

A particular embodiment of the method in accordance with the present invention comprises a method for the addition of magnesium to a molten ferrosilicon bath wherein the recovery of the magnesium in the molten ferrosilicon bath upon the dissolution of the magnesium in the ferrosilicon bath is increased over that recovery obtained without the gaseous atmosphere.

The improvement of the method of the present invention is a method wherein improved recoveries of reactive metals in molten metal baths are achieved efficiently and economically by use of a gaseous atmosphere offering the advantages of:

low concentration of the protective agent $SF_6$ with resultant low concentration of decomposition products;

low cost of providing the protective atmosphere relative to the savings achieved from the resulting improved metal recoveries, and ease of production of the protective $SF_6$ bearing gaseous mixtures and applying such mixtures to the volume above a molten bath surface.

DESCRIPTION OF THE PREFERRED EMBODIMENTS

In the practice of the method of the present invention, a gaseous atmosphere containing a mixture of small quantities of $SF_6$ and a nonreactive diluent gas is established above the surface of a molten metal bath into which a reactive metal will be introduced in order to increase the recovery of the reactive metal addition in the bath. The temperature of the molten metal bath is such that the vapor pressure of the reactive metal at that temperature exceeds the total ambient pressure above the surface of the bath. The reactive metal addition floats on the surface of the molten bath and gradually dissolves therein forming an alloy.

The molten metal bath is prepared in a conventional manner in a crucible, ladle or the like using for example a stationary or tilting crucible furnace or a coreless induction furnace. In the preferred practice of the present invention, the area above the surface of the molten metal bath is enclosed by a shroud or a cover thus forming an enclosed volume over the surface of the bath so as to prevent free communication between the surface of the molten metal bath and the ambient atmosphere, Although it is not required that the cover of the preferred practice of the present invention provide an air tight seal between the enclosed volume over the surface of the molten metal bath and the ambient atmosphere, the cover or shroud will most preferably substantially prevent free fluid communications between the enclosed volume and the outside ambient atmosphere with minor leakage being permissible. The cover or shroud is preferrably fitted with tubing for the introduction of the protective $SF_6$-nonreactive diluent gas mixture, exhaust ports for the escape of fumes and excess gas, a port for the introduction of the reactive metal addition, and, as required, penetrations for conventional mechanical stirring devices or tubes for the introduction of gas for stirring the molten metal bath. Such modifications to a shrouded or covered conventional molten metal bath for the preferred practice of the present invention will be readily apparent to one skilled in the art.

Molten metal baths and reactive metal additions for which the method of the present invention is contemplated for use include those hereinbefore described.

The molten metal baths for the practice of the method of the present invention are characterized as having temperatures such that the vapor pressure of the reactive metal being added to the bath at the bath temperature exceeds the total ambient pressure above the surface of the bath.

The reactive metal addition in the practice of the method of the present invention may be in either solid or liquid form. As the reactive metals contemplated for use in the method of the present invention float on the surface of the molten metal bath, accompanied by dissolution therein, the temperature of the metal addition comes up to bath temperature.

In industrial scale applications in which the method of the present invention is contemplated for use, the total ambient pressure over the bath would not be significantly affected by the vaporization of the reactive metal addition. However, the method of the present invention would be applicable whenever the vapor pressure of the reactive metal addition at the bath temperature exceeds the total pressure over the bath. The method of the present invention is particularly contemplated for use with the addition of metals and base alloys thereof of Group 2a* of the periodic table and most particularly magnesium, calcium, strontium, and barium because of their low melting points and high vapor pressures to molten metal baths particularly molten baths of ferrosilicon alloys, i.e. iron base alloys containing 20% to 80% silicon.

*Reference: Handbook of Chemistry and Physics, The Chemical Rubber Co., 45th Edition, 1964–1965, page B-2.

Nonreactive diluent gases contemplated for use in the $SF_6$-nonreactive diluent gas mixture include nitrogen, carbon dioxide and the noble gases particularly argon and helium. Nitrogen or argon is particularly suitable for use as a nonreactive diluent gas. Commercially available grades of the foregoing nonreactive diluent gases are satisfactory for the practice of the method of the present invention. The $SF_6$ gas contemplated for use in the method of the present invention is commercial grade.

In the practice of the method of the present invention, a molten metal bath, for example one of those hereinbefore described, is conventionally prepared. $SF_6$ and a nonreactive diluent gas are blended together to produce a mixture containing about 100 to 3000 parts per million $SF_6$ and preferably about 1000 to 2000 parts per million.

The $SF_6$-nonreactive diluent gas mixture is introduced over the surface of the molten metal bath forming a gaseous atmosphere and substantially excludes the surface of the molten metal bath from free communication with the ambient atmosphere. The reactive metal addition is conventionally added to the bath for dissolution therein. Suitably, the $SF_6$-nonreactive diluent gas mixture establishing the atmosphere above the surface of the molten metal bath is continuously introduced over the surface of the bath just prior to, during and until the reactive metal addition has dissolved in the bath.

In a particular embodiment of the present invention, the $SF_6$-diluent gas mixture is injected under pressure or by pumping into the hereinbefore described enclosed volume above the surface of a molten metal bath prior to the addition of the reactive metal or alloy. The shroud or cover forming the enclosed volume over the surface of the molten metal bath includes as hereinbefore described an exhaust port or ports for the escape of gas and fumes, and the enclosed volume above the molten metal bath is purged to substantially remove the presence of other gases by a continuous flow of the $SF_6$-nonreactive diluent protective gas prior to the addition of the reactive metal. The reactive metal or alloy addition is then conventionally added to the bath, for example by dropping ingots, blocks or chips of the reactive metal through a chute penetrating the cover or shroud above the surface of the bath. The molten metal bath may be conventionally stirred by mechanical means or by injecting a gas such as nitrogen or argon below the surface of the bath. In the preferred practice of the method of the present invention, the $SF_6$-diluent gas is likewise continuously injected into the enclosed volume above the molten metal bath surface during the addition of the solid reactive metal and until the reactive metal has been dissolved in the bath. Preferably the $SF_6$-diluent gas is injected into the enclosed volume so that the gas flows over the surface of the molten metal in the bath.

The optimum $SF_6$ concentration to provide a satisfactory protective atmosphere above the surface of the bath for a particular application is determined by the reactive metal or alloy being added to the bath, the $SF_6$-diluent gas flow rate, the gas exhaust flow rate, and if applicable, the gas mixer flow rate or the intensity of mechanical stirring used in the particular application.

With reference to the drawing, a particular embodiment of a method in accordance with the present invention directed to the addition of magnesium to a molten ferrosilicon bath is as follows:

A molten metal bath 10 of 50% ferrosilicon (e.g., 48–52% Fe, 51–47% Si, balance incidental impurities) is conventionally held in a ladle 20 having a carbon paste lining 30. The bath is maintained at a temperature of about 1320° C. to 1450° C.

A cover 50 is mounted on the open end of ladle 20 forming an enclosed volume 60 above the molten metal 10. The seal 70 formed by the engagement of the periphery of cover 50 with the ladle 20 substantially prevents free fluid communication between the enclosed volume 60 and the outside ambient atmosphere.

The cover 50 includes a first port 80 for the passage of a first tube 90, preferably constructed of graphite, for the introduction of the hereinafter described $SF_6$-nonreactive diluent gas mixture into the enclosed volume 60. The extension of tube 90 into enclosed volume 60 terminates above the surface 120 of molten metal 10. The end 100 of tube 90 near molten metal surface 120 is preferably plugged with tube 90 containing a plurality of holes 110 in the tube wall near end 100 located so as to cause the hereinafter described injected $SF_6$-diluent gas mixture to be dispersed radially from the tube 90 and flow over molten metal surface 120. The cover 50 includes a second port 130 for the passage of a second tube 140, preferably constructed of graphite, which tube 140 extends below molten metal surface 120 a depth sufficient to cause the stirring of molten metal 10 upon the hereinafter described introduction of a gas, suitably nitrogen. The end 150 of tube 140 located below molten metal surface 120 is preferably plugged with tube 140 having a hole 160 in the tube wall near end 150 so as to cause the hereinafter described injected gas to be introduced into the molten metal 10 so as to effect the stirring of molten metal 10. The cover 50 includes a third port 170 for the passage of a conduit 180 which terminates upon penetration of cover 50. Conduit 130 provides for the exhaust of the hereinafter described gas and fumes and for the hereinafter described addition of reactive metal 300.

In the practice of the particular embodiment of the present invention, with the molten ferrosilicon bath maintained at a temperature of about 1320° C. to 1450° C., a blended protective gas mixture of 100 to 3000 parts per million $SF_6$ and nonreactive gas such as nitrogen or argon is prepared and injected continuously over the molten metal surface 120 through tube 90 for a time sufficient to substantially purge enclosed volume 60 of other gases by the $SF_6$-nonreactive diluent gas mixture with excess gas escaping through conduit 180. Prior to the reactive metal addition nitrogen is injected through tube 140 to effect the stirring of the molten ferrosilicon bath with excess gas likewise escaping through conduit 180.

At the completion of the purge of the enclosed volume 60, solid commercial grade magnesium in the form of ingots, blocks or chips is introduced into the molten ferrosilicon by the passage of the solid magnesium through conduit 180 with the magnesium settling by its own weight in the molten bath accompanied by dissolution therein.

Injection of the $SF_6$-diluent protective gas mixture through tube 90 is continued during the magnesium addition until completion of the manganese dissolution in the bath. Likewise, the injection of nitrogen through tube 140 for stirring the molten metal bath is continued during this period. Excess gas and fumes caused by the vaporization of the magnesium introduced into the molten ferrosilicon escape through conduit 180.

The vapor pressure of magnesium at temperature ranges of 1320° C. to 1450° C. is 3414 mm Hg to 7270 mm Hg and thus substantially exceeds the total ambient pressure over the surface of the molten bath which is essentially at atmospheric pressure that is approximately 760 mm Hg.

The amount of magnesium to be added would be readily ascertainable by one skilled in the art depending on the amount of the magnesium desired to be added to the ferrosilicon. Magnesium additions of about 1% to 9% based by weight can be readily made. The optimum $SF_6$ concentration forming the atmosphere above the surface of the molten bath would be determined in part by the protective gas flow rate, the gas flow rate of the exhaust and the gas flow rate of the mixer gas.

As an illustration, in the hereinbefore described embodiment, an $SF_6$-nitrogen protective gas mixture containing 2000 parts per million $SF_6$ would be advantageous metered in at a flow rate of about 30 SCFM with a nitrogen mixing gas metered in at a flow rate of 40 SCFM for a molten metal bath containing 22,000 pounds of 50% FeSi at a temperature maintained at about 1430° C. (2600° F.) wherein about a 5 percent addition of magnesium is added to the bath in the form of ingots. Magnesium recoveries in the final cast alloy of about 80 percent of the total magnesium added when using the $SF_6$-nitrogen atmosphere (2000 ppm $SF_6$) above the surface of the molten metal bath are obtainable while only about 77% recoveries can be obtained without the use of the dilute $SF_6$ atmosphere.

This increase in magnesium recoveries represents a substantial metal savings in commercial plant scale operations.

To more particularly illustrate the method of the present invention, various tests were performed as described in the following examples:

EXAMPLE I 950 grams of 50% ferrosilicon (51% Fe, 48% Si, balance incidental impurities) in approximately 1 inch cube lump form were melted in a 3 inch internal diameter graphite crucible. To this melt, 3.5 grams of alloying grade calcium-silicon (28–32% Ca balance Si, with incidental impurities) were added for the purpose of simulating a production grade ferrosilicon bath composition and the melt was mechanically stirred for approximately one-half minute. When the resulting melt reached 1400°–1425° C., a pin-tube sample of the melt was taken and found to contain 0.04% magnesium (chemical analysis) by weight which is designated % Mg(Base) and represents the percent residual magnesium present in the bath prior to the magnesium addition.

The crucible was covered with a cover which included a first port to permit the blowing of the $SF_6$-diluent gas mixture over the molten metal and a second port to permit the escape of excess gases.

A mixture of commercial grade argon and commercial grade $SF_6$ was blended to provide 130 parts per million $SF_6$. The argon-130 ppm $SF_6$ was blown over the surface of the melt metered in at 5 scfh. After the argon-130 ppm gas was blown over the bath surface for approximately 10 minutes so as to purge the residual ambient atmosphere from the enclosed volume between the surface of the molten metal and the crucible cover, 50 grams of commercial grade magnesium in the form of approximately 5 gram cubes (obtained from a 50 pound magnesium ingot) were dropped into the molten bath through an opening in the crucible cover over a 5 minute period. The bath was maintained at a temperature of 1400° to 1425° C. which temperatures correspond to a magnesium vapor pressure of about 5570 mm Hg to 6380 mm Hg. The surface of the molten metal bath was at approximately atmospheric pressure, i.e., approximately 760 mm Hg. During the period of the magnesium addition, the bath was mechanically stirred and the argon-130 ppm $SF_6$ protective gas was continuously blown over the surface of the bath metered in at 5 scfh. Stirring and blowing of the argon-130 ppm $SF_6$ gas continued after the addition of the last magnesium cube until all the magnesium was dissolved in the bath. After the last magnesium addition, pin tube samples were taken of the bath at the times hereinafter indicated and analyzed by chemical analysis for percent magnesium based on weight where the time of the first sample is designated t=0.

% Mg(Base)=0.04%

| Time (minutes) | % Mg (analysis) | % Mg (recovery) |
|---|---|---|
| t = 0 | 3.5 | 68 |
| t = 5 | 3.4 | 66 |
| t = 10 | 3.2 | 64 |

The percent magnesium recovery is calculated by the following formula:

$$\%\ Mg(recovery) = \frac{(\%\ Mg(analysis) - \%\ Mg(base)) \times \text{Total Alloy Weight}}{\text{Weight of Mg Addition}}$$

An identical test was run with the exception that argon was blown over the molten bath surface without the presence of $SF_6$. Results were as follows:

% Mg(Base)=0.6%

| Time (minutes) | % Mg (analysis) | % Mg (recovery) |
|---|---|---|
| t = 0 | 2.2 | 32 |
| t = 5 | 1.8 | 24 |
| t = 10 | 1.8 | 24 |

EXAMPLE II

Identical to Example I except that 83 grams of magnesium were added in the form of approximately 5 gram cubes to the molten bath using the argon-130 ppm $SF_6$ protective gas metered in at 5 scfh. Results were as follows:

% Mg(Base)=0.7%

| Time (minutes) | % Mg (analysis) | % Mg (recovery) |
|---|---|---|
| t = 0 | 5.1 | 55 |
| t = 5 | 5.1 | 55 |

-continued

| Time (minutes) | % Mg (analysis) | % Mg (recovery) |
|---|---|---|
| t = 10 | 4.5 | 47 |

An identical test was run with the exception that argon was blown over the molten bath surface without the presence of $SF_6$. Results were as follows:

% Mg(Base)=0.6%

| Time (minutes) | % Mg (analysis) | % Mg (recovery) |
|---|---|---|
| t = 0 | 3.9 | 41 |
| t = 3 | 3.6 | 38 |
| t = 6 | 3.1 | 31 |

Example I and Example II thus demonstrate that an argon-130 ppm $SF_6$ gas mixture establishing an atmosphere above a molten ferrosilicon bath in accordance with the method of the present invention increases a magnesium addition recovery in the molten ferrosilicon bath held at a temperature at which the vapor pressure of magnesium significantly exceeds the total ambient pressure above the ferrosilicon bath over that recovery obtained without the presence of $SF_6$.

EXAMPLE III

Identical to Example I except that a blended nitrogen ($N_2$)—100 ppm $SF_6$ gaseous mixture was blown over the surface of the molten metal bath metered in at 5 scfh. The nitrogen was commercial grade. Results were as follows:

% Mg(Base)=0.6%

| Time (minutes) | % Mg (analysis) | % Mg (recovery) |
|---|---|---|
| t = 0 | 3.2 | 52 |
| t = 4 | 3.3 | 54 |
| t = 8 | 3.4 | 56 |

An identical test was run with the exception that nitrogen ($N_2$) was blown over the molten metal bath surface without the presence of $SF_6$. Results were as follows:

% Mg(Base)=0.6%

| Time (minutes) | % Mg (analysis) | % Mg (recovery) |
|---|---|---|
| t = 0 | 3.3 | 54 |
| t = 4 | 3.1 | 50 |
| t = 8 | 2.7 | 42 |

Example III thus demonstrates that a nitrogen-100 ppm $SF_6$ gas mixture establishing an atmosphere above a molten ferrosilicon bath in accordance with the method of the present invention increases a magnesium addition recovery in the molten ferrosilicon bath held at a temperature at which the vapor pressure of the magnesium significantly exceeds the total ambient pressure above the ferrosilicon bath over that recovery obtained without the presence of $SF_6$.

EXAMPLE IV

On a plant scale, a series of 10 trials were made adding magnesium to a molten ferrosilicon bath wherein a $N_2$–$SF_6$ gaseous atmosphere was established above the surface of the bath in accordance with the method of the present invention and 10 trials were made using $N_2$ gas without the presence of $SF_6$.

The trials were made in a molten ferrosilicon bath held in a conventional 15 ton capacity ladle fitted with a cover. A graphite gas injector tube was mounted through the ladle cover with the end of the graphite tube being plugged. The wall of the injector tube near the plugged end contained a plurality of orifices approximately $\frac{1}{8}$ inch in diameter so located to be below the rim of the ladle but above the molten metal bath surface so as to cause gas injected through the tube to be dispersed radially from the tube and flow over the molten metal surface. A graphite lance was mounted through the ladle cover and located in a manner so as to have its outlet submerged below the molten metal surface in order to inject $N_2$ gas to effect the stirring of the molten metal bath. Provision was made in the ladle cover for discharge of excess gas and fumes and for the addition of magnesium ingots.

The trials were conducted in the following manner: a molten bath of ferrosilicon (46% Si, 1% Ca, 1% Al, 1% Ce, 0.5% Mn, balance Fe) was prepared and maintained in the ladle at a temperature ranging from 1327° C. to 1510° C. for the various trials at which temperatures the vapor pressure of magnesium ranges from about 3665 mm Hg to 9800 mm Hg respectively. The total ambient pressure above the surface of the molten ferrosilicon bath was approximately atmospheric pressure, i.e. approximately 760 mm Hg. The weight of the molten ferrosilicon bath varied from 19,950 to 24,820 pounds to which 1320 to 1920 pounds of commercial grade magnesium would be added.

For ten trials, a nitrogen—1000 ppm $SF_6$ gaseous mixture was prepared by connecting a cylinder of commercial grade $SF_6$ gas to a plant nitrogen gas line (commercial grade nitrogen gas) and the mixture was injected through the gas injector tube so as to flow over the molten bath surface at a metered in rate of about 16 SCFM in order to purge the residual ambient atmosphere from the volume enclosed between the molten surface and the ladle cover for a period of five minutes prior to the magnesium addition. Magnesium was then dropped through an opening provided in the ladle cover into the molten bath in the form of approximately 50 pound commercial grade magnesium ingots. The $N_2$-1000 ppm $SF_6$ gaseous mixture was continuously injected over the molten surface during the period of magnesium addition and after the completion of the magnesium addition until the magnesium addition was substantially all dissolved in the bath. During the course of the 10 trials, the metered flow rate over the bath surface was maintained at about 16 SCFM containing about 1000 ppm $SF_6$.

Nitrogen (commercial grade) was injected through the graphite lance below the surface of the molten metal bath at a metered rate of about 22 SCFM in order to stir the bath during the time of magnesium addition commencing prior to the addition and continuing until after the magnesium is dissolved in the bath.

For ten trials, the hereinbefore described procedure was followed except that the $N_2$-1000 ppm $SF_6$ gaseous mixture was not injected over the molten metal surface. However, a nitrogen atmosphere was established over the surface of the bath by the $N_2$ injected below the surface of the molten bath to effect the stirring of the bath.

The average magnesium recovery in the final cast ferrosilicon alloy for the 10 trials using the $N_2$-1000 ppm $SF_6$ protective gaseous mixture in accordance with the method of the present invention was 79.2%. The average magnesium recovery without the presence of $SF_6$ was 76.9%. The percent magnesium recovered was calculated by dividing the final percent magnesium in the alloy multiplied by the total alloy weight by the total weight of the magnesium addition to the molten bath.

Thus Example IV demonstrates that commercially significant increases (2.3% average) are obtained in the amount of magnesium recovered in a molten ferrosilicon bath at a temperature at which the vapor pressure of magnesium significantly exceeds the total ambient pressure above the surface of the bath by the use of a gaseous mixture of small quantities of $SF_6$ and a nonreactive diluent gas forming a protective atmosphere over the bath in accordance with the method of the present invention practiced in plant scale operations.

EXAMPLE V

Identical to Example IV except a nitrogen-2000 ppm gaseous protective mixture was used with a metered in flow rate of 40 SCFM. The ferrosilicon alloy used for the molten bath had the analysis of 46% Si, 1% Ca, 1% Al, 0.5% Mn, 0.5% Ce, balance Fe with the weight of the molten ferrosilicon bath varying from 15,000 to 27,000 pounds to which 1100 to 2000 pounds of commercial grade magnesium would be added.

The average magnesium recovery in the molten ferrosilicon alloy for 22 trials using the $N_2$-2000 ppm $SF_6$ gaseous mixture in accordance with the method of the present invention was 79.6%. The average magnesium recovery without the presence of $SF_6$ for 22 trials was 76.9%.

Thus Example V likewise demonstrates that commercially significant increases (2.7% average) are obtained in the amount of magnesium recovered by the practice of the method of the present invention. Example V also demonstrates that increased recoveries can be obtained by increasing the amount of the protective agent, $SF_6$, present in the atmosphere established over the surface of the bath.

Thus the foregoing examples demonstrate that an atmosphere containing a mixture of small quantities of gaseous $SF_6$ and a nonreactive diluent gas above a molten metal bath in accordance with the method of the present invention will increase the recovery of a reactive metal added to a molten metal bath having a temperature at which the vapor pressure of the reactive metal exceeds the total ambient pressure upon the dissolution of the reactive metal in the molten metal bath over that recovery obtained without the use of the $SF_6$-nonreactive diluent gas atmosphere.

While the foregoing examples are directed to the addition of a solid reactive metal to a molten metal bath, it is apparent to one skilled in the art that the method of the present invention is readily adaptable to the addition of liquid reactive metals to a molten metal bath wherein the temperature of the molten metal bath is such that the vapor pressure of the liquid reactive metal addition exceeds the total ambient pressure.

An upper range of about 3000 ppm $SF_6$ in the $SF_6$-nonreactive diluent gas mixture in accordance with the method of the present invention has been selected since possible corrosive action of products of $SF_6$ decomposition on, for example, duct work or fume collectors may occur at higher $SF_6$ concentrations.

The method of the present invention is contemplated for the addition of reactive metals and particularly the addition of magnesium, calcium, strontium, or barium to molten metal baths wherein the total ambient pressure above the surface of the molten bath suitably ranges from about 0.5 to 15 atmospheres and most suitably ranges from about 1 to 5 atmospheres.

What is claimed is:

1. A method for the addition of a reactive metal to a molten metal bath which comprises:
(a) providing a bath of molten metal;
(b) establishing a gaseous atmosphere above the surface of said bath consisting essentially of a nonreactive gas containing from about 100 to 3000 parts per million $SF_6$;
(c) establishing said bath of molten metal at a temperature at which a selected reactive metal exhibits a vapor pressure exceeding the total ambient pressure of the gaseous atmosphere above the surface of said bath;
(d) depositing said selected reactive metal on the surface of said bath for dissolution therein.

2. A method in accordance with claim 1 wherein said reactive metal is selected from the group consisting of magnesium, calcium, strontium and barium.

3. A method in accordance with claim 2 wherein said bath consists essentially of molten ferrosilicon.

4. A method in accordance with claim 1 wherein said reactive metal is magnesium.

5. A method in accordance with claim 1 wherein said $SF_6$ ranges from about 1000 to 2000 parts per million.

6. A method in accordance with claim 1 wherein said nonreactive gas is selected from the group consisting of nitrogen, argon, carbon dioxide and helium.

7. A method in accordance with claim 1 wherein said nonreactive gas is selected from the group consisting of nitrogen and argon.

8. A method for the addition of a reactive metal to a molten ferrosilicon bath which comprises:
(a) providing a bath of molten ferrosilicon
(b) establishing a gaseous atmosphere above the surface of said bath consisting essentially of a nonreactive gas containing from about 100 to 3000 parts per million $SF_6$ wherein said nonreactive gas is selected from the group consisting of nitrogen, argon, carbon dioxide and helium;
(c) establishing said bath of molten ferrosilicon at a temperature at which a reactive metal selected from the group consisting of magnesium, calcium, strontium and barium exhibits a vapor pressure exceeding the total ambient pressure of the gaseous atmosphere above the surface of said bath;
(d) depositing said reactive metal selected from the group consisting of magnesium, calcium, strontium and barium on the surface of said bath for dissolution therein.

9. A method in accordance with claim 8 wherein said $SF_6$ ranges from about 1000 to 2000 parts per million.

10. A method in accordance with claim 8 wherein said nonreactive gas is selected from the group consisting of nitrogen and argon.

11. A method for the addition of magnesium to a molten ferrosilicon bath which comprises:
(a) providing a bath of molten ferrosilicon;
(b) establishing a gaseous atmosphere above the surface of said bath consisting essentially of a nonreactive gas containing from about 100 to 3000 parts per million $SF_6$;

(c) establishing said bath of ferrosilicon at a temperature at which said magnesium exhibits a vapor pressure exceeding the total ambient pressure of the gaseous atmosphere above the surface of said bath;

(d) depositing said magnesium on the surface of said bath for dissolution therein.

12. A method in accordance with claim 11 wherein said $SF_6$ ranges from about 1000 to 2000 parts per million.

13. A method in accordance with claim 11 wherein said nonreactive gas is selected from the group consisting of nitrogen, argon, carbon dioxide and helium.

14. A method in accordance with claim 11 wherein said nonreactive gas is selected from the group consisting of nitrogen and argon.

* * * * *

UNITED STATES PATENT AND TRADEMARK OFFICE

CERTIFICATE OF CORRECTION

PATENT NO. : 4,214,899

DATED : July 29, 1980

INVENTOR(S) : Ronald H. Radzilowski

It is certified that error appears in the above-identified patent and that said Letters Patent are hereby corrected as shown below:

Column 3, line 42, change the word "path" to --bath--.

Column 7, line 10, change the quantity "3414 mm Hg" to --3514 mm Hg--.

Signed and Sealed this

*Twenty-fifth* Day of *June 1985*

[SEAL]

*Attest:*

DONALD J. QUIGG

*Attesting Officer* *Acting Commissioner of Patents and Trademarks*